US009602908B2

(12) United States Patent
Venables

(10) Patent No.: US 9,602,908 B2
(45) Date of Patent: Mar. 21, 2017

(54) SET OF HEADPHONES AND HEADPHONE CABLE

(71) Applicant: Carl Venables, Fillongley (GB)

(72) Inventor: Carl Venables, Fillongley (GB)

( * ) Notice: Subject to any disclaimer, the term of this patent is extended or adjusted under 35 U.S.C. 154(b) by 0 days.

(21) Appl. No.: 14/778,969

(22) PCT Filed: Mar. 20, 2014

(86) PCT No.: PCT/GB2014/050884

§ 371 (c)(1),
(2) Date: Sep. 21, 2015

(87) PCT Pub. No.: WO2014/147409

PCT Pub. Date: Sep. 25, 2014

(65) Prior Publication Data

US 2016/0066075 A1 Mar. 3, 2016

(30) Foreign Application Priority Data

Mar. 21, 2013 (GB) ..... 1305172.7

(51) Int. Cl.
*H04R 1/38* (2006.01)
*H04R 1/10* (2006.01)

(52) U.S. Cl.
CPC ..... *H04R 1/1033* (2013.01)

(58) Field of Classification Search
CPC ..... A42B 1/245; A42B 3/30; H04R 1/1008; H04R 1/1016; H04R 1/1033; H04R 1/1058;

(Continued)

(56) References Cited

U.S. PATENT DOCUMENTS 8,269,110 B2 * 9/2012 Scifo ..... H02G 3/0475 174/135
8,290,193 B2 * 10/2012 Pang ..... H04R 1/1033 381/370

(Continued)

FOREIGN PATENT DOCUMENTS

KR 01-24138 Y 10/1998
KR 20-0181938 Y 5/2000

(Continued)

OTHER PUBLICATIONS

PCT Written Opinion of the International Searching Authority, PCT/GB2014/050884, Applicant: Venables, Date of mailing: Jun. 26, 2014.

(Continued)

*Primary Examiner* — Brian Ensey
(74) *Attorney, Agent, or Firm* — Pedersen and Company, PLLC; Ken J. Pedersen; Barbara S. Pedersen

(57) ABSTRACT

This invention relates to a set (or pair) of headphones, and in particular to a set of in-ear headphones as may be used with a personal media device. According to the invention there is provided a set of headphones having a jack plug and at least one earpiece, the jack plug being connected to the at least one earpiece by a flexible cable, the jack plug being connected to a jack plug end of the flexible cable, the set of headphones having a receiver adapted to temporarily secure the jack plug, the receiver being spaced away from the jack-plug end. There is also provided a cable for a set of headphones.

8 Claims, 4 Drawing Sheets

(58) Field of Classification Search
CPC .... H04R 1/1066; H04R 5/033; H04R 5/0335; H04R 2201/023; H04R 2201/107
USPC ..... 381/309, 311, 370, 374, 376, 380, 384; 439/131; 455/569.1
See application file for complete search history.

(56) References Cited

U.S. PATENT DOCUMENTS

| | | | |
|---|---|---|---|
| 2010/0150370 | A1 | 6/2010 | Bales et al. |
| 2010/0159741 | A1 | 6/2010 | Rothbaum |
| 2010/0215186 | A1 | 8/2010 | Chang |
| 2012/0045084 | A1 | 2/2012 | Groset et al. |
| 2012/0148052 | A1 | 6/2012 | Adam |

FOREIGN PATENT DOCUMENTS

| | | | |
|---|---|---|---|
| KR | 20-0272819 | Y | 8/2002 |
| WO | 2010-132501 | A2 | 11/2010 |

OTHER PUBLICATIONS

PCT International Search Report, PCT/GB2014/050884, Applicant: Venables, Date of mailing: Jun. 26, 2014.
GB Combined Search and Examination Report, Application No. GB1405030.6, Applicant: Vanavles, Date of search: Sep. 10, 2014, Date of report: Sep. 11, 2014, Intellectual Property Office, UK.

* cited by examiner

SET OF HEADPHONES AND HEADPHONE CABLE

FIELD OF THE INVENTION

This invention relates to a set (or pair) of headphones, and in particular to a set of in-ear headphones (often called earphones), as may be used with a personal media device such as an MP3 player, MP4 player, mobile telephone, smart phone, e-book reader, tablet computer, or the like. The invention also relates to the cable for the headphones, by which the headphones are connected to the jack plug.

BACKGROUND TO THE INVENTION

Most MP3 players require the use of headphones in order for the user to listen to music. Thus, these devices typically do not have any built-in (internal) speakers and so are designed for use with headphones. The headphones are typically connected to the MP3 player by way of a jack plug and a length of flexible cable.

Furthermore, many devices such as mobile telephones, tablet computers, laptop computers and desktop computers have internal speakers, but nevertheless benefit greatly from the use of headphones. Such devices are often used to play music, and can also be used to display films, television programmes and games. The internal speakers which are fitted to such devices are often of low quality and whilst they may be suitable for voice communication they do not reproduce music or other media with an acceptable sound quality. Also, the user will often wish to listen to music without disturbing others, so that the use of headphones is necessary. Accordingly, the manufacturers of mobile telephones and the like will typically provide an audio socket to receive the jack plug of a set of headphones, even if the device has an internal speaker.

The present invention can be utilised with any personal media device having an audio socket for headphones, whether or not the device has an internal speaker.

For example, the present invention can be used with MP3 players, MP4 players, mobile telephones, tablet computers, laptop computers, desktop computers, CD players, DVD players, Bluray players, TV sets, AM/FM/DAB radios, guitar amplifiers and video games consoles (for example).

As indicated above, the headphones are connected to the personal media device by a length of flexible cable, the flexible cable terminating in a jack plug (of standard form) which can be inserted into the audio socket (also of standard form) of the device. The cable will often be around one meter long, permitting the user to use the headphones whilst carrying the device in a waist pocket or the like.

Headphones fall into two broad classes which are distinguished by the size and shape of their earpieces. The first class has two cup-shaped earpieces, each of which is designed to be placed against the user's head and surround a respective ear. The earpieces are typically mounted upon a support which fits over the user's head. The second class has much smaller earpieces, each of which is designed to fit snugly into a user's ear. Headphones in the second class are often referred to as in-ear headphones, earphones or earbuds. The present invention has been designed for use with in-ear headphones, and the following description will therefore relate to this class. It will be understood, however, that the invention could also be used with the first class of headphones if desired.

The known in-ear headphones have a number of known disadvantages. Firstly, when not in use the flexible cable will often become entangled during storage, requiring the user to untangle the cable before the headphones can be used. The likelihood of entanglement could be reduced by reducing the flexibility of the cable but that option is seldom adopted as a more flexible cable makes the headphones far easier to manipulate and use once they have been untangled.

Secondly, the electrical signal wire within the cable can become damaged during storage, or during the untangling procedure, with the signal wire of a tangled cable perhaps being bent around curves with very small radii of curvature. Over time, such damage can become irrevocable, i.e. the signal wire can break.

Another problem arises because each earpiece of a pair of in-ear headphones requires its own signal wire. This problem does not typically arise with the first class of headphones as a single cable carrying both signal wires can be connected to one of the earpieces and a signal wire can be passed along the support to the other earpiece. However, since in-ear headphones do not utilise a support each earpiece must be connected directly to the jack plug.

Notwithstanding the requirement for two separate signal wires, the manufacturers of in-ear headphones have appreciated that the signal wires can be connected together for much of their length, whereby to reduce slightly the likelihood of the separate signal wires becoming entangled. The in-ear headphones' cable therefore typically has a general Y-shape, with two separate earpiece cables each carrying a single signal wire meeting at the junction (or "splitter") of the "Y", and a single jack plug cable running from the splitter to the jack plug which carries both signal wires.

The two earpiece cables are typically of smaller cross-section than the jack plug cable, and are usually very flexible. Their small cross-sectional dimension, and their significant flexibility, results in the earpiece cables being the most likely to become entangled and damaged during a typical storage and subsequent untangling procedure. Accordingly, it is desirable to minimise the length of the earpiece cables. However, the earpiece cables must be sufficiently long to permit all users easily and conveniently to position each of the earpieces in a respective ear, with the attached cables being sufficiently long that the headphones are comfortable to use. There is therefore a compromise between reducing the length of the separate earpiece cables so as to reduce the likelihood of entanglement and damage, and increasing the length of the separate earpiece cables so as to increase the ease of use and comfort of the user.

As an example, a known set of in-ear headphones has a cable with a total length of around 120 cm, and earpiece cables with a length of around 35 cm. Such a cable therefore has a total earpiece cable length of around 70 cm, the earpiece cable being very thin and very flexible, and being easily tangled during storage. It can be very difficult and time consuming subsequently to untangle the earpiece cables. The jack plug cable of this known cable has a length of around 85 cm and is also thin and flexible, the jack plug cable contributing significantly to the overall likelihood of entanglement. It will be understood that the stated lengths are representative, and in-ear headphones having longer and shorter cable lengths are also known, as are in-ear headphones with a greater and lesser proportion of their total length taken up by the earpiece cables.

It is known to provide a movable keeper to hold the separate earpiece cables together, the keeper being a loop surrounding both of the earpiece cables. The user can slide the keeper towards the earpieces whereby to reduce the effective free length of the separate cables, and alternatively can slide the keeper away from the earpieces whereby to increase the effective free length. Such a keeper can slightly reduce the likelihood of entanglement during storage, but is usually only partially successful. Thus, it is necessary for the user to slide the keeper to a suitable position along the separate earpiece cables before the cable is wound up for storage, and only the most diligent of users will routinely do this. Often, the keeper will be slid away from the earpieces during use, perhaps close to the splitter where the earpiece cables join with the jack plug cable, and will not be moved before the in-ear headphones are stored, so that it will have little or no benefit in reducing the likelihood of entanglement.

Prior art documents U.S. 2005/0069147, WO 20012/064669 and U.S. 2012/0045084 seek to reduce the disadvantage of the above-stated compromise by forming the earpiece cables with a series of interconnecting formations so that the two earpiece cables have the form of a zip fastener and can therefore be interconnected and disconnected as desired.

There is another problem associated with headphone and earphone cables, which these prior art documents do not address. Specifically, there in no easy way to store the cables during the periods when they are not in use. Many users will simply collect up the cable and store it in a pocket, for example (or perhaps in a drawer if the period of non-use is expected to be longer). More diligent users may wind up the cable prior to storage. The collecting up and/or winding up of the cable increases the likelihood that the cable will become entangled, even if the earpiece cables have been interconnected by use of the zip-fastener arrangements of the prior art.

SUMMARY OF THE INVENTION

The inventor seeks to provide a set of headphones which can more easily be stored when not in use, and which are expected to be less liable to entanglement during storage.

According to the invention there is provided a set of headphones having a jack plug and at least one earpiece, the jack plug being connected to the at least one earpiece by a length of flexible cable, the jack plug being connected to a jack plug end of the flexible cable, the set of headphones having a receiver adapted to temporarily secure the jack plug, the receiver being spaced away from the jack-plug end.

The receiver can be provided by, or be adjacent to, the at least one earpiece. The at least one earpiece can be located at an earpiece end of the flexible cable, the earpiece end and the jack plug end comprising the opposite ends of the flexible cable.

Preferably, the jack plug and the earpiece have respective cooperating elements, the earpiece element comprising the receiver.

Desirably, the receiver is a socket which can accommodate a part of the jack plug, ideally a socket for the terminal of the jack plug.

Preferably, there are two earpieces and the length of flexible cable has two signal wires and two earpiece cables, each earpiece cable carrying a respective signal wire. The earpiece cables can be connected together at a splitter, in which case the receiver can be located in or adjacent to the splitter.

Desirably, the earpiece cables both have a set of cooperating releasable interconnecting formations and the set of headphones has a movable fastener, the movement of the fastener in use causing the two earpiece cables to be connected together by the user, or separated by the user, depending upon the direction of movement of the fastener along the earpiece cables. In such embodiments the receiver can be located in or adjacent to the fastener.

Alternatively, the earpiece(s) can provide the receiver, the jack plug and/or the at least one earpiece containing a magnet to provide for the temporary securement of the jack plug in engagement with the at least one earpiece.

Ideally, the shaping (or profile) of the earpieces matches the shaping of the jack plug, facilitating their temporary securement. Also, the jack plug and earpiece(s) when secured together form an aesthetically pleasing combination.

It will be understood that providing a receiver for the jack plug which is spaced away from the jack plug end results in a portion of the flexible cable being between the jack plug end and the receiver. That portion of the flexible cable will be formed into a loop when the jack plug is temporarily secured by the receiver, the looped cable facilitating storage when the set of headphones is not in use. The portion of the flexible cable can if desired be the full length of the cable.

In the embodiments in which the earpiece cables have cooperating releasable interconnecting formations, the cables can be interconnected and separated in a manner similar to that of a zip fastener. The user can separate the interconnecting formations during use, whereby to separate the earpiece cables and facilitate ease of use and make the headphones more comfortable to wear.

Alternatively, the user can interconnect the formations prior to storage of the headphones, whereby to reduce the likelihood of the flexible cable becoming entangled and perhaps damaged during storage.

The user can furthermore connect the jack plug to the receiver so as to form the intervening cable into a loop. The looped cable can readily be stored around the user's neck, or around the user's wrist (the cable being formed into a number of overlying loops), or in another suitable location. It is expected to be especially desirable to some users that the set of headphones can be formed into a set of multiple overlying loops for storage around the user's wrist during periods of non-use. The cable may be brightly coloured to enhance the visual appearance when the set of headphones is stored (worn) in this way.

Preferably, the releasable interconnecting formations are continuous along the earpiece cables. Thus, unlike the prior art arrangements which replicate a zip fastener and comprise a sequence of alternating (discrete) interconnecting formations on each of the cables, the present invention has one continuous-length formation on one earpiece cable and another continuous-length formation on the other earpiece cable. It is expected that continuous formations will be less liable to suffer damage which might impair the interconnection and/or separation, and thereby be more reliable long term.

In common with the prior art arrangements, it is preferably arranged that movement of the fastener towards the earpieces causes the earpiece cables to become connected together. Movement of the fastener towards the splitter causes the earpiece cables to become separated.

Movement of the fastener towards the earpieces prior to storage is a rapid and straightforward procedure which most users are likely to undertake. In doing so, the earpiece cables will become interconnected for most or all of their length, and the likelihood of entanglement during storage is therefore reduced. The temporary storage of the jack plug by the receiver (for example by way of the insertion of the jack plug terminal in a socket of an earpiece) is also a rapid and straightforward procedure which most users are expected to undertake prior to storage. Even if the flexible cable is subsequently collected together, or is wound up, for storage, the securement of the jack plug is expected to significantly reduce the likelihood of entanglement.

The subsequent release of the jack plug, and the separation of the earpiece cables, is a similarly rapid and straightforward procedure which is likely to encourage the utilisation of the invention.

There is also provided a cable for a set of headphones, the cable being flexible and being connected to a jack plug, the jack plug being connected to a jack plug end of the flexible cable, the cable having a receiver adapted to temporarily secure the jack plug, the receiver being spaced away from the jack-plug end.

BRIEF DESCRIPTION OF THE PREFERRED EMBODIMENTS

The invention will now be described in more detail, by way of example, with reference to the accompanying drawings, in which.

DETAILED DESCRIPTION

Figure 1:
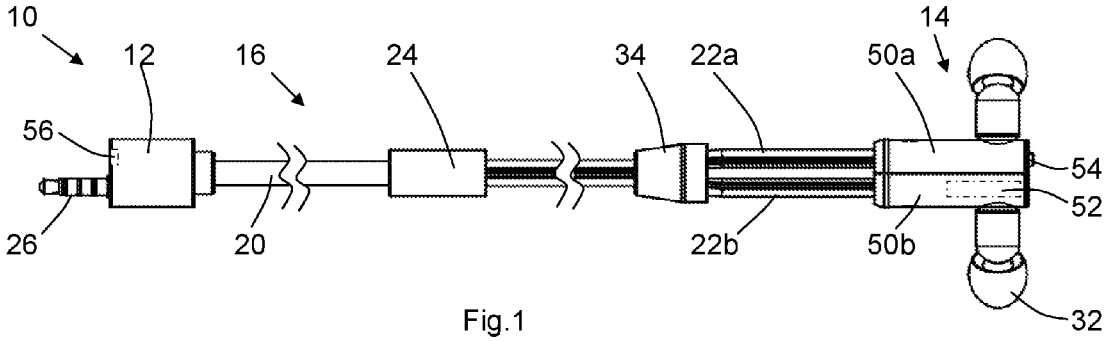
FIG. 1 shows a set of in-ear headphones according to a first embodiment of the present invention, with the earpieces temporarily connected together.

The in-ear headphones 10 according to the present invention can be provided in a number of different embodiments and styles to match personal tastes. Only two of the many available embodiments are shown in the drawings. All embodiments will be provided with a jack plug (ideally a stereo jack plug 12), at least one earpiece (and ideally two earpieces 14), and a length of flexible cable 16 connecting the jack plug 12 to the earpieces 14.

The cable 16 carries two separate signal wires (not shown in FIG. 1 but see the signal wires 18 in the embodiment of FIG. 6) and comprises a first part (or jack plug cable) 20 in which the two signal wires are located within a common sheath or casing, and two second parts (or earpiece cables) 22*a*, 22*b* each of which carries a single signal wire in a respective sheath or casing. The jack plug cable 20 and the earpiece cables 22*a*, 22*b* are joined at a splitter 24.

The jack plug 12 is connected to one terminal end of the flexible cable 16, which is herein referred to as the jack plug end of the cable. The earpieces 14 are each connected to a terminal end of an earpiece cable 22*a,b*, which are herein referred to as the earpiece end of the cable.

It will be understood that the terminal 26 of the stereo jack plug 12 is of standard form so that it can be inserted into the standard audio socket of a personal media device (not shown) such as an MP3 player for example. In preferred embodiments the separate sections of the terminal 26 are gold plated.

The jack plug cable 20 is preferably longer than the earpiece cables 22*a,b*, i.e. the splitter 24 is closer to the earpieces 14 than to the jack plug 12. Thus, whilst as explained below it is advantageous to provide an adjustable free length 30 (see FIG. 5) for the earpiece cables 22*a,b*, it is not believed to be required for the adjustment to span more than a minor proportion of the total length of the cable 16. In preferred embodiments therefore, the length of the jack plug cable 20 is between 50 and 80 cm, usefully between 60 and 75 cm, and ideally around 70 cm, whilst the length of the earpiece cables 22*a* and 22*b* is between 30 cm and 50 cm, and ideally around 45 cm.

The earpieces 14 each have a flexible earbud 32, ideally of silicone, which locates within the user's ear in use. Preferably, the in-ear headphones 10 are supplied with a set of (perhaps three) differently-sized pairs of earbuds to permit the user to fit the pair of earbuds which most-closely match his or her ears.

Figure 4:
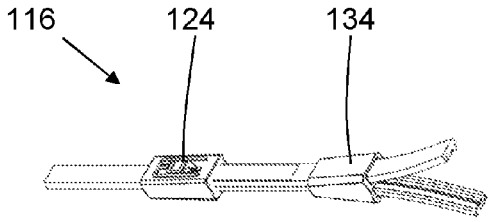
FIG. 4 shows a perspective view of part of the cable of a second embodiment of the present invention.

Between the splitter 24 and the earpieces 14 the cable 16 carries a fastener 34. The function of the fastener 34 is best understood in relation to FIGS. 4-6 which show part of the second embodiment of cable 116 and its fastener 134.

Figure 5:
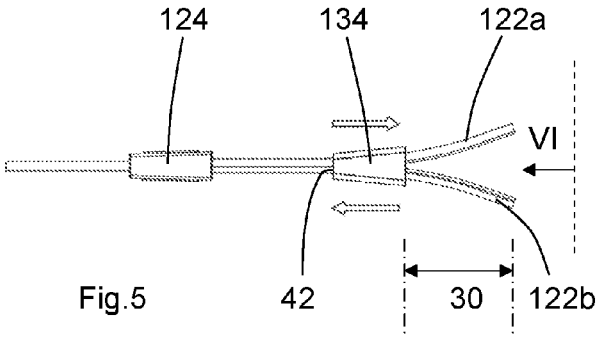
FIG. 5 shows a side view of the part of the cable of FIG. 4.

As shown in FIG. 5, the fastener 134 can slide along the earpiece cables 122*a,b*. The fastener 134 surrounds the cables 122*a,b* and has three openings. The first opening 40*a* accommodates the earpiece cable 122*a*, the second opening 40*b* accommodates the earpiece cable 122*b*, and the third opening 42 accommodates both of the earpiece cables 122*a* and 122*b*.

Figure 6:
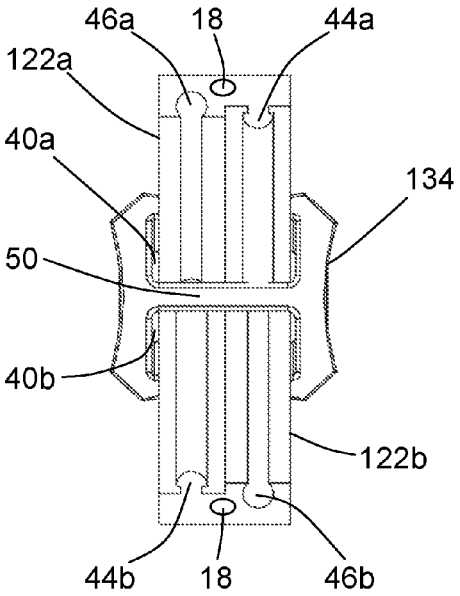
FIG. 6 shows a view in the direction VI of FIG. 5.

As seen in FIG. 6, the earpiece cables 122*a,b* each have cooperating interconnecting formations, in this embodiment a respective projecting strip 44*a,b* and a respective channel 46*a,b*. The projecting strip 44*a* can be pressed into the channel 46*b*, and the projecting strip 44*b* can be pressed into the channel 46*a*.

The cables 122*a,b* are manufactured from plastics material which is sufficiently flexible and resilient to permit the strips 44*a,b* and the channels 46*a,b* to deform and allow the respective strips 44*a,b* to enter their channels 46*b,a*, and to be released from those channels, repeatedly. When the strips 44 are located in the channels 46, however, the cables 122*a,b* are coupled together, effectively as a single cable.

In preferred embodiments of the present invention there are two projecting strips 44*a,b*, and two channels 46*a,b*, and these are continuous along the full length of the earpiece cables 122*a,b*. It will be understood, however, that a single strip on one cable could interconnect with a single channel on the other cable, or alternatively three or more strips and channels could be provided, as desired. In other embodiments the channel(s) are continuous, but the strips are discontinuous.

It will be seen that the earpiece cables 122*a,b* are generally rectangular in section, and that their longer edges carry the interconnecting elements. The earpiece cables of the prior art arrangements are also generally rectangular, but their narrow edges carry the interconnecting elements. The present arrangement is expected to be more reliable in practice, especially after long-term and often-repeated use.

The fastener 134 has a web 50 which separates the first and second openings 40*a,b*. The web 50 terminates away from the third opening 42 and the third opening is only large enough to accommodate the earpiece cables 122*a,b* when the strips 44*a,b* are located in the respective channels 46*a,b*. The function of the fastener 134 is therefore somewhat similar to that of a zip fastener, in that movement of the fastener 134 towards the earpieces (i.e. to the right as drawn in FIGS. 4 and 5) causes the projecting strips 44*a,b* to be pressed into the respective channels 46*b,a* as the earpiece cables 122*a,b* pass through the fastener 134 (and in particular through the third opening 42). Conversely, as the fastener 134 is moved towards the splitter 124 i.e. to the left as drawn in FIGS. 4 and 5, the unseen end of the web 50 is forced between the earpiece cables 122*a,b* and separates the projecting strips 44*a,b* from their channels 46*b,a*.

It will therefore be understood that the free length 30 of the earpiece cables 122*a,b* can be determined by the position of the fastener 134 (and similarly the position of the fastener 34 can be adjusted to determine the free length of the earpiece cables 22*a,b*).

It is an added benefit that the releasable interconnecting formations 44*a,b*, 46*a,b*, when connected together, somewhat reduce the flexibility of the cable 16, 116.

Thus, the earpiece cables 22*a,b* and 122*a,b* are sufficiently thin and flexible to bend and twist whereby to permit the user to manipulate the earpieces 14 as required, and to be comfortable for the user. When connected together, however, the earpiece cables 22*a,b*, 122*a,b* have reduced flexibility, so reducing the likelihood of entanglement and/or damage during storage.

The continuous adjustability of the free length 30 of the earpiece cables 22*a,b*, 122*a,b*, in particular over their entire length as in the embodiments described (which is ideally around 45 cm as above stated) is particularly beneficial for users, especially those using the in-ear headphones 10 for sports activities such as running, for example.

Figure 2:
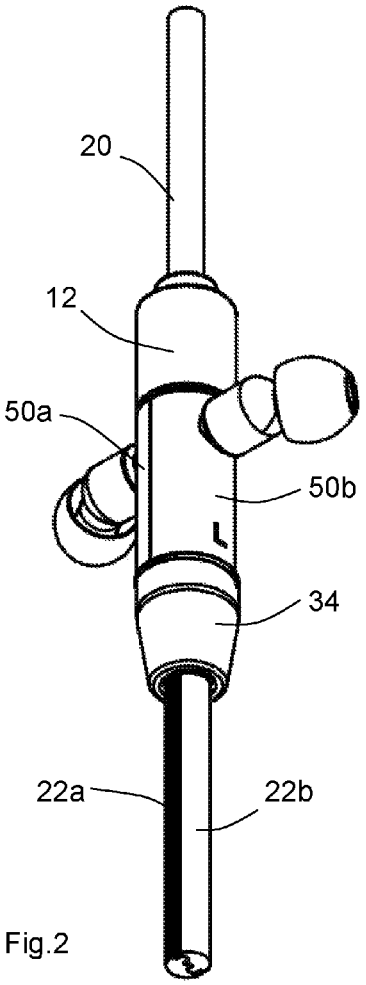
FIG. 2 shows a view of the part of the set of headphones of FIG. 1, with the jack plug temporarily connected to the combined earpieces.
Figure 3:
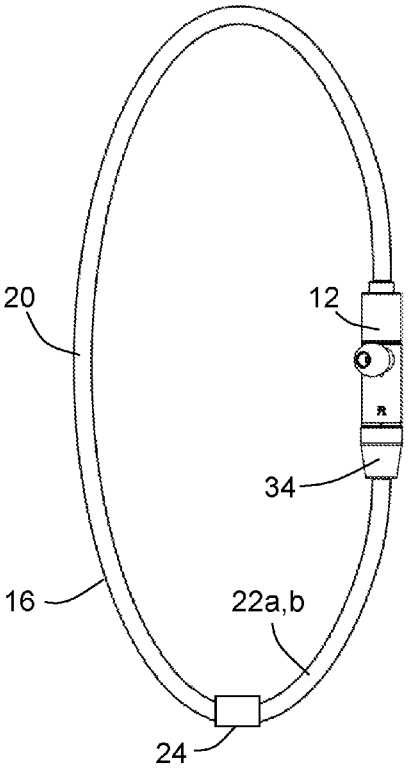
FIG. 3 shows a view of the headphones of FIG. 2 in a storage condition.

Though not shown in detail, the earpiece cables 22*a,b* of the embodiment of FIGS. 1-3 are generally semi-circular in cross-section. The flat engaging surfaces of the cables 22*a,b* in this embodiment carry formations which are substantially identical to the formations 44*a,b*, 46*a,b* of the second embodiment.

According to the invention the jack plug can be temporarily secured to a receiver carried by another part of the flexible cable, further reducing the likelihood of entanglement and damage during storage. In the embodiment of FIGS. 1-3 the earpieces 14 have respective rigid housings 50*a,b*, each of which is substantially semi-circular in cross-section. One of the housings 50*a,b* contains a magnet and the other contains a metallic element whereby the housings are attracted to one another. The magnetic attraction is sufficiently strong to prevent inadvertent separation, during storage for example, but the earpieces 14 can nevertheless be separated when desired by the user.

In other embodiments the earpieces 14 can be temporarily secured by a clip or other mechanical means, in addition to or as an alternative to the magnetic attraction.

One mechanical means for temporarily securing (or further securing) the earpiece housings 50*a,b* together is by way of the fastener 34, which can be slid along the cables 22*a,b* sufficiently to slightly overlie the ends of the housings 50*a,b* and mechanically hold them together (as shown in FIGS. 2 and 3).

As seen in FIG. 1, the earpiece housing 50*b* has a receiver 52, in this embodiment formed as a socket which can accommodate the terminal 26. The housing 50*a* also has a projecting peg 54 which can be located within a corresponding recess 56 in the jack plug 12, whereby to provide an additional (temporary) mechanical connection. The jack plug 12 can therefore be temporarily secured to the combined housings 50*a,b*, resulting in the cable 16 forming a loop as shown in FIG. 3. The looped cable can if desired be stored around the user's neck, for example during an airline flight, when more permanent storage of the unused cable is not required, or can be hung up in a suitable location for storage.

Figure 7:
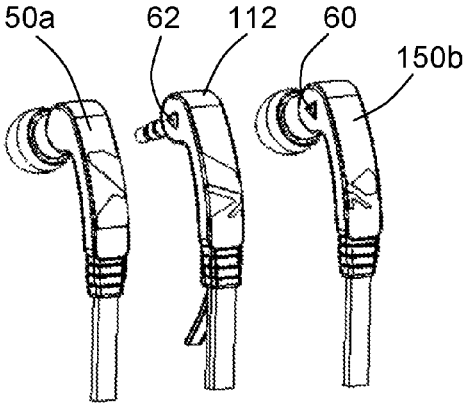
FIG. 7 shows a perspective view of the earpieces of an alternative embodiment of the present invention.
Figure 8:
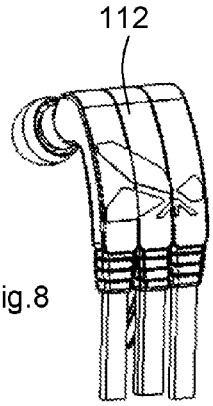
FIG. 8 shows a perspective view of the earpieces of FIG. 7 temporarily secured together.

Alternatively, rather than being formed into a single loop as in FIG. 3, the flexible cable can be wound into multiple overlying loops, suitable for storage (wearing) around a user's wrist for example In the alternative embodiment of FIGS. 7 and 8, the earpiece housings 150*a, b* are not secured directly together, but are rather secured to opposed sides of the jack plug 112. It will be apparent from FIG. 8 in particular that the earpiece housings 150*a,b* and the jack plug 112 are similarly formed, to facilitate their temporary securement and to provide an aesthetically pleasing combination. The jack plug 112 contains a magnet and each of the earpiece housings 150*a,b* contains a metallic insert whereby the earpiece housings together provide a receiver for the jack plug, the respective components being temporarily secured together by way of magnetic attraction. In addition, each of the earpiece housings 150*a,b* has a recess 60, and the jack plug 112 has corresponding projections 62, providing a mechanical connection to ensure the correct relative positions. Alternatively, a purely mechanical temporary connection can be provided.

Figure 9:
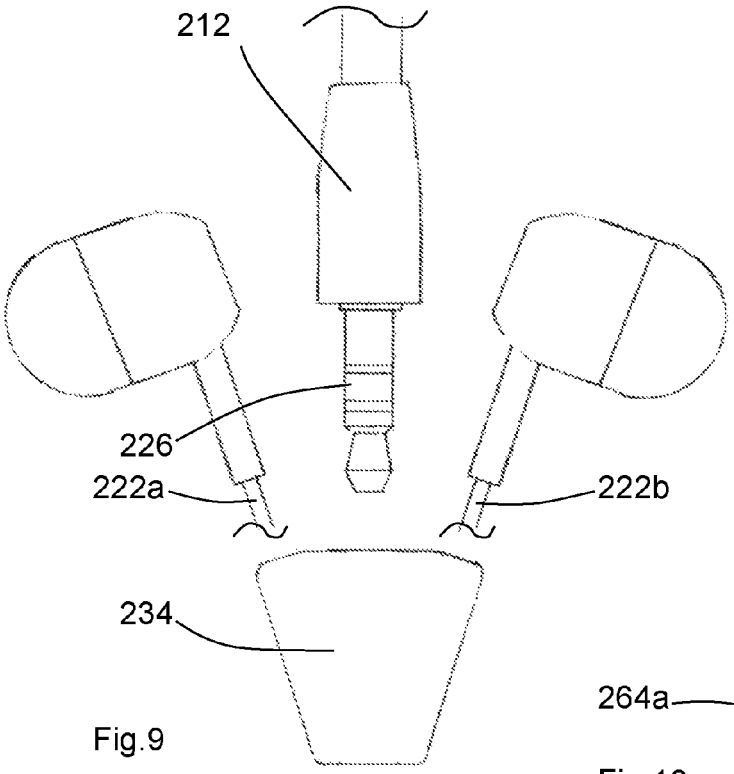
FIG. 9 shows a part of a set of headphones according to a third embodiment of the invention.
Figure 10:
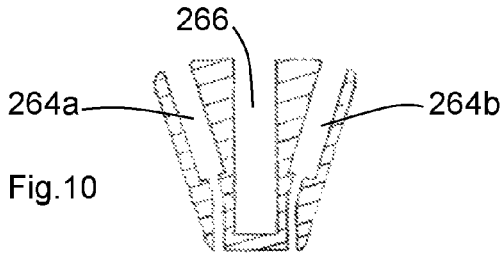
FIG. 10 shows a sectional view through the splitter of the third embodiment.
Figure 11:
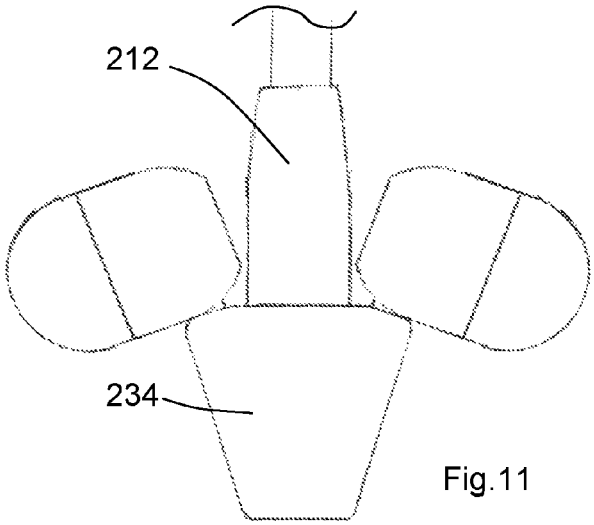
FIG. 11 shows a view as FIG. 9 but with the terminal of the jack plug located within the receiver.

FIGS. 9-11 show a third embodiment in which the receiver is provided by the slider 234. As will be better understood in relation to the sectional view of FIG. 10, the slider 234 comprises a plastics moulding having a first passage 264*a* for the first earpiece cable 222*a*, and a second passage 264*b* for the second earpiece cable 222*b*. Each earpiece cable 222*a,b* can slide through its respective passage 264*a,b*, into the condition shown in FIG. 11 (or alternatively stated the slider 234 can be slid along the earpiece cables to a chosen position).

In the embodiment shown the slider 234 does not include means to interconnect the earpiece cables 222*a,b* and so the earpiece cables remain separate in this embodiment, even in the stored condition. The earpiece cables 222*a,b*, therefore do not include cooperating interconnecting formations in this embodiment. It will be understood, however, that an alternative embodiment can mount a fastener alongside the slider 234, the fastener being able to interconnect cooperating formations of the earpiece cables in known fashion. Alternatively, the slider could be adapted to act also as a fastener to interconnect and separate the earpiece cables.

The slider 234 also has a receiver in the form of a socket or recess 266 which is sized to accommodate the terminal 226 of the jack plug 212. The terminal 226 is preferably a suitably tight fit within the recess 266 that it can be temporarily secured therein (as shown in FIG. 11), i.e. until it is removed by the user.

In an alternative embodiment the receiver is provided by the splitter. The splitter could appear very similar to the slider of FIGS. 9 and 10, and in particular the ends of the respective earpiece cables could be secured in the respective passages 264*a,b* by adhesive or welding.

Figure 12:
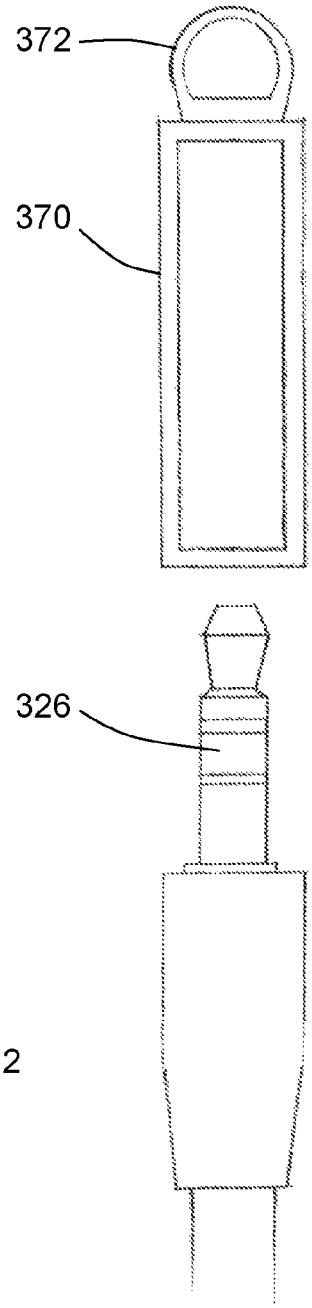
FIG. 12 shows a part of a set of headphones according to a fourth embodiment.
Figure 13:
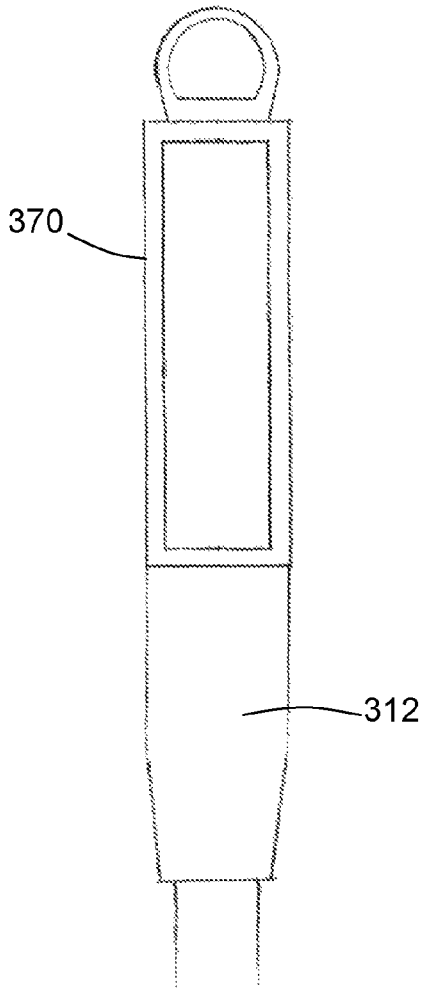
FIG. 13 shows a view as FIG. 12 but with the terminal of the jack plug located within the receiver.

FIGS. 12 and 13 show a fourth embodiment in which the receiver is provided by the fastener. In common with many zip fasteners, the fastener has a small tab or puller 370, the tab 370 being connected to the remainder of the fastener by way of the ring 372. It will be understood that the tab 370 is designed to be gripped by the user when it is desired to move the fastener. The tab 370 is generally tubular and has a socket or recess (not seen) to receive the terminal 326 of the jack plug 312. The terminal 326 is preferably a suitably tight fit within the recess that it can be temporarily secured therein (as shown in FIG. 13), i.e. until it is removed by the user.

In an alternative embodiment a magnet (or metallic element) could be located in the splitter, or in the fastener, in place of the socket or recess.

It will be appreciated that in all of the embodiments the jack plug is connected to the jack plug end of the flexible cable and can also be temporarily secured by the receiver spaced away from the jack plug end. When so secured, the flexible cable between the jack plug and the receiver will be formed into one or more loops which allows the wearing or storage of the set of headphones, as above explained. Specifically, the user can hold the receiver and the jack plug and can wind the flexible cable around his or her wrist (for example) a chosen number of times before securing the jack plug to the receiver (e.g. by inserting the jack plug terminal into the receiver). The length of flexible cable forming the loop will depend partly upon the location of the receiver, i.e. whether the receiver is provided by the earpieces as in the first embodiment, by a slider as in the third embodiment, by the splitter, or by the fastener as in the fourth embodiment. It will also be understood that the receiver could alternatively be located at an intermediate position along the jack plug cable, or upon one of the earpiece cables, as desired.

In preferred embodiments of the invention each signal wire is located within a respective earthed sheath within its casing, whereby to minimise electrical interference.

In alternative embodiments the earpiece cables can be temporarily interconnected by a sequence of alternating, discrete, formations so as to replicate a conventional zip fastener. In such embodiments it is desirable to separate the signal wire from the interconnecting formations, so that the likelihood of the signal wire becoming damaged by the repeated interconnection and separation of the formations is reduced. Thus, it is desirable to provide an earpiece cable having a first portion to carry the signal wire and a second portion to carry the interconnecting formations.

The signal wire and other electrical elements of the in-ear headphones 10 are manufactured to meet the requirements of the personal media device. For example, the jack plug 12,112 and cable 16 together have an impedance of 160 or 320 and a frequency response of 20 Hz-20 kHz.

The invention claimed is:

1. A set of headphones having a jack plug and two earpieces, the jack plug being connected to the earpieces by a flexible cable having two signal wires and two earpiece cables, each earpiece cable carrying a respective signal wire, the jack plug being connected to a jack plug end of the flexible cable, the set of headphones having a receiver adapted to temporarily secure the jack plug, the receiver being spaced away from the jack-plug end, the earpiece cables each having a set of cooperating releasable interconnecting formations comprising at least one strip located on one of the earpiece cables and at least one cooperating channel located on the other of the earpiece cables, and the set of headphones having a fastener which is movable along the earpiece cables, the location of the fastener relative to the earpiece cables dividing the earpiece cables into a length of interconnected earpiece cables and a length of separated earpiece cables, the receiver being provided by the fastener.

2. The set of headphones according to claim 1 in which the receiver is a socket which can accommodate a part of the jack plug.

3. The set of headphones according to claim 2 in which the jack plug has a terminal, and in which socket is adapted to accommodate the terminal.

4. The set of headphones according to claim 1 in which the earpiece cables are connected together at a splitter.

5. The set of headphones according to claim 1 in which the releasable interconnecting formations are continuous along the earpiece cables.

6. The set of headphones according to claim 1 in which the releasable interconnecting formations are discontinuous along the earpiece cables.

7. The set of headphones according to claim 1 in which the fastener has first and second openings each configured to accommodate a single earpiece cable and a third opening configured to accommodate the interconnected earpiece cables, the fastener having a web separating the first and second openings.

8. The set of headphones according to claim 7 in which the first, second and third openings are each substantially rigid.

* * * * *